US009749740B2

(12) United States Patent
Borkhovik et al.

(10) Patent No.: US 9,749,740 B2
(45) Date of Patent: Aug. 29, 2017

(54) METHOD AND APPARATUS FOR EXPANDED TEMPERATURE OPERATION OF A PORTABLE COMMUNICATION DEVICE

(71) Applicant: MOTOROLA SOLUTIONS, INC, Schaumburg, IL (US)

(72) Inventors: German Borkhovik, Prairie View, IL (US); Mark A. Prudden, Chicago, IL (US); Daniel Grobe Sachs, Elmhurst, IL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 14/943,844

(22) Filed: Nov. 17, 2015

(65) Prior Publication Data

US 2017/0142517 A1 May 18, 2017

(51) Int. Cl.
*H04R 3/00* (2006.01)
*H04R 29/00* (2006.01)

(52) U.S. Cl.
CPC ..... *H04R 3/007* (2013.01); *H04R 29/001* (2013.01); *H04R 2430/01* (2013.01)

(58) Field of Classification Search
CPC ..... H04R 3/007
USPC ..... 224/257; 327/513; 381/59; 455/67.11; 709/106, 324; 713/300, 324; 718/105
See application file for complete search history.

(56) References Cited

U.S. PATENT DOCUMENTS

| | | | | |
|---|---|---|---|---|
| 6,271,634 | B1 * | 8/2001 | Saiger | H05B 37/0254 315/241 S |
| 7,395,440 | B2 | 7/2008 | Nokkonen | |
| 7,782,218 | B2 | 8/2010 | Krempl et al. | |
| 7,831,842 | B2 * | 11/2010 | Adachi | G06F 1/206 703/21 |
| 8,942,857 | B2 | 1/2015 | Anderson et al. | |
| 8,948,922 | B2 | 2/2015 | Schleuthner | |
| 2002/0173858 | A1 * | 11/2002 | Sherlock | G05B 23/027 700/1 |
| 2003/0229662 | A1 * | 12/2003 | Luick | G06F 1/206 718/106 |
| 2005/0010827 | A1 * | 1/2005 | McAfee | G06F 1/206 713/300 |
| 2005/0216775 | A1 * | 9/2005 | Inoue | G06F 1/206 713/300 |

(Continued)

FOREIGN PATENT DOCUMENTS

| | | | |
|---|---|---|---|
| WO | 2014043491 | A1 | 3/2014 |
| WO | 2014045705 | A1 | 3/2014 |

*Primary Examiner* — Gerald Gauthier
(74) *Attorney, Agent, or Firm* — Barbara R. Doutre

(57) ABSTRACT

A method and apparatus for operation of a remote speaker microphone over an expanded temperature range. By monitoring a temperature of the communication device, a temperature sensitive microprocessor can be disabled above a predetermined extreme temperature, thereby allowing control of an audio path of the communication device to be modified. Microphone and speaker signals of the communication device can be switched or rerouted to an electronic path capable of operating above the predetermined extreme temperature for expanded operation while previous microprocessor controlled digital and analog audio circuits are shut down.

19 Claims, 3 Drawing Sheets

(56) References Cited

U.S. PATENT DOCUMENTS

| | | | | |
|---|---|---|---|---|
| 2006/0095911 | A1* | 5/2006 | Uemura | G06F 1/206 718/100 |
| 2008/0016374 | A1* | 1/2008 | Gee | G06F 1/3203 713/300 |
| 2008/0028244 | A1* | 1/2008 | Capps | G06F 1/206 713/324 |
| 2010/0073068 | A1* | 3/2010 | Cho | G05D 23/1934 327/513 |
| 2010/0138530 | A1* | 6/2010 | Brillhart | G06F 1/206 709/224 |
| 2011/0138395 | A1* | 6/2011 | Wolfe | G06F 1/206 718/105 |
| 2011/0235817 | A1* | 9/2011 | Lin | H04R 1/1041 381/74 |
| 2015/0140936 | A1* | 5/2015 | Sachs | H04W 4/22 455/67.11 |
| 2016/0081446 | A1* | 3/2016 | Maddox | A45C 11/00 224/257 |
| 2017/0142517 | A1* | 5/2017 | Borkhovik | H04R 3/007 |

* cited by examiner

METHOD AND APPARATUS FOR EXPANDED TEMPERATURE OPERATION OF A PORTABLE COMMUNICATION DEVICE

FIELD OF THE INVENTION

The present invention relates generally to portable communication devices and more particularly to portable radio devices that require audio operation capability over extreme temperatures.

BACKGROUND

The present invention relates generally to portable communication devices and more particularly to portable radio devices that require audio operation capability over extreme temperatures. Portable battery-powered communication devices are advantageous in many environments, but particularly in public safety environments such as fire rescue, first responder, and mission critical environments. Portable communication devices used by public safety personnel include, for example, portable radios operated in conjunction with accessories, such as remote speaker microphones and other audio accessories that must operate over extreme temperature conditions. The ability to have a product rated as compliant with certain test specifications, for example temperature compliance specifications outlined in the National Fire Protection Association Specifications (NFPA1802) can be very beneficial in achieving high product satisfaction.

Challenges arise when designing public safety radios and their associated audio accessories where the audio includes a digital processing unit where most components used for digital processing are not capable of operating to required temperature extremes. While some known techniques have been acceptable for normal radio operation, such techniques are not deemed acceptable for mission critical operation. For example, simply turning off certain audio functions under high temperatures is not considered acceptable under mission critical operation. Likewise reducing performance of mission critical audio, such as by reducing audio gain is not considered acceptable.

Accordingly, there is a need for a portable radio with improved audio operation capability over expanded temperature range for mission critical operation.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
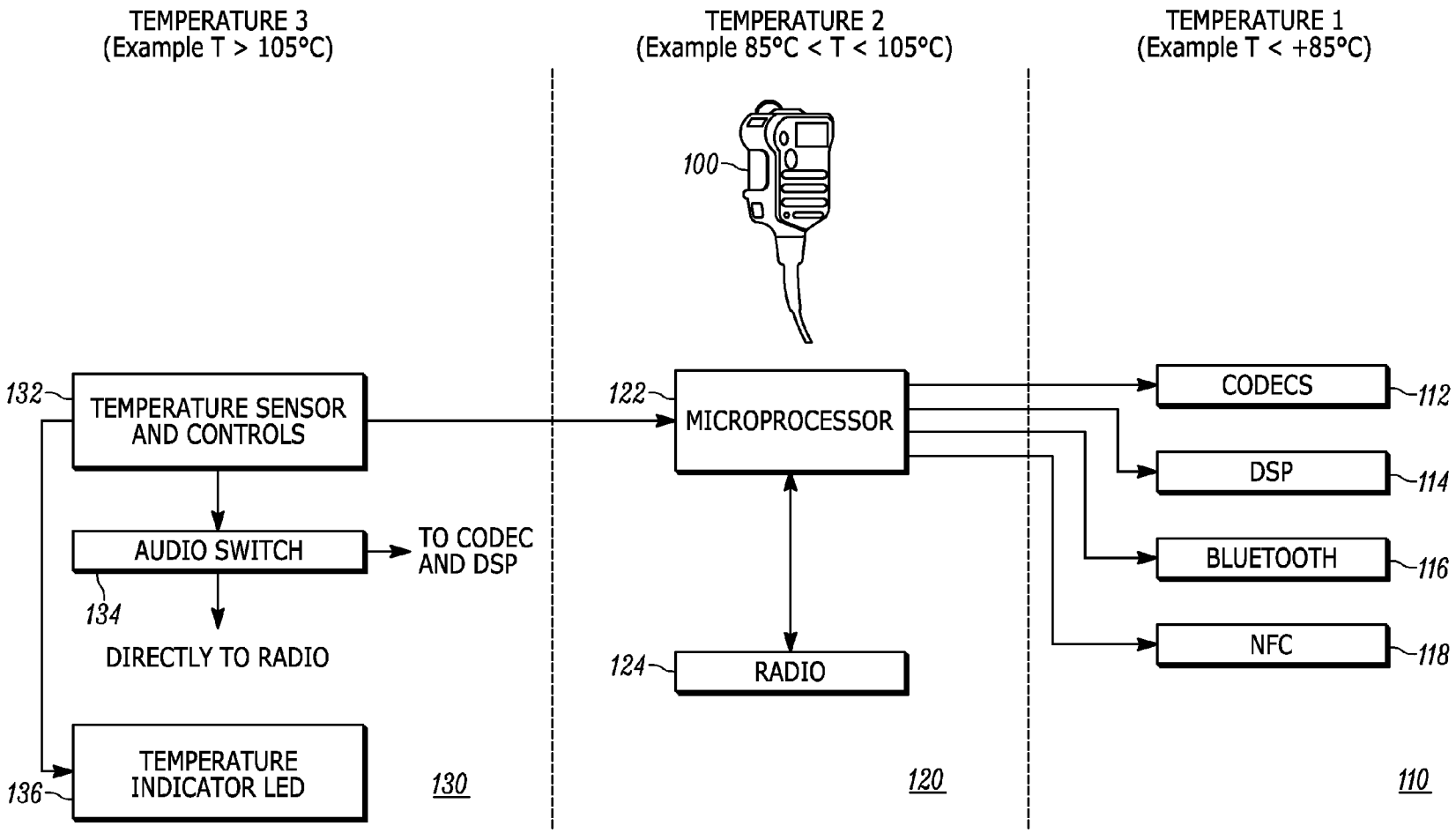
FIG. 1 is functional block diagram of expanded temperature operation for a communication device in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is described herein a method and apparatus for expanded temperature operation of a communication device. By monitoring a temperature of the communication device, the method provides for disabling a temperature sensitive microprocessor, upon reaching a predetermined extreme temperature. Disabling microprocessor control results in switching an audio path so that microphone and speaker signals of the communication device can be processed via an electronic path capable of operating at predetermined extreme temperature conditions. High temperature performance circuitry is switched in that does not rely on the RSM's microprocessor or DSP.

As the temperature moves through different temperature ranges, functionality of certain devices is initially turned off and ultimately upon reaching an extreme predetermined temperature the system changes to a minimal number of different higher performance circuits. In accordance with the various embodiments, the ability to turn off features systematically as temperatures meet different thresholds and then switch over and reroute to a set of high temperature performance circuitry for audio functionality allows for an audio communication device, such as a remote speaker microphone (RSM), to remain operational in very high temperature, fire type environments. The design of a mission critical audio device, such as provided herein, is advantageous in for achieving NFPA1802 compliance under predetermined test conditions. Mission critical audio is defined herein as audio that operates even in the event of software failure and even over extreme temperature ranges. An RSM's digital signal processor having, for example noise suppression software, is not capable of operating to certain predetermined temperature extremes that are encountered in fire related environments. The RSM formed in accordance with the embodiments can now bypass the software and operate using analog audio to provide mission critical audio functionality, without the use of the DSP or microprocessor, at these higher temperature extremes. Similarly, the embodiments can be applied to lower temperature extremes as well. Additionally, a hardware bypass around the software is made available at each temperature range allowing mission critical audio to be enabled at each temperature range in the event of a software failure.

FIG. 1 is functional block diagram of expanded temperature operation for a communication device, such as a remote speaker microphone (RSM) 100 formed and operating in accordance with some embodiments. The RSM 100 is wired to a portable two-way radio (not shown) and operates over a plurality of different temperature (T) operating ranges comprising a first temperature range 110, a second temperature range 120, and a third temperature range 130. For this embodiment, predetermined temperature ranges 110, 120, 130 have been selected in accordance with NFPA1802 test specifications and thus the first temperature range 110 is temperature (T) where −40 degrees Celsius<T<+85 degrees Celsius, the second temperature range falls between +85<T<+105 degrees Celsius, and the third temperature range falls between +125>T>+105 degrees Celsius. The challenge is to maintain mission critical audio operation across the predetermined temperature ranges. It is understood that the RSM 100 can also be designed for different temperature ranges including other high temperature ranges, extreme low temperature ranges, and interim ranges without departing from the scope of the embodiments.

Temperature is monitored via a temperature sensor and controls 132 for determining the operating temperature range for RSM 100. The remote speaker microphone 100 operating within the first temperature range 110 provides full RSM functionality, sometimes referred to as "smart" RSM functionality. In this range the audio processed through the RSM includes both digital audio and analog audio signal processing under the control of a microprocessor 122. The analog audio is switched 134 through to a codec 112 for conversion to a digital signal and for combining with the digital audio for processing through a digital signal processing unit (DSP) 114 where noise suppressions algorithms are applied to provide advanced audio communications. The combined signal is fed back through the codec 112 for conversion from digital back to analog for transmission to a radio. Additional digital audio features such as BLUETOOTH capability, for example to a headset and near field communication (NFC) capability, such as a tag reader for personal location tracking, may also be available for some RSM devices. The smart RSM replicates the functionality of the radio including, push-to-talk (PTT) for transmit and receive, emergency, volume control, channel change, and LED indicators. This first temperature range thus provides for a fully functional RSM in the form of digital audio and analog audio. In the event of a software failure of the DSP 114 under microprocessor control 122 during the first temperature range 110 (or any temperature range), mission critical audio is available via the hardware audio switch bypass 134 to the analog audio.

As the monitored temperature 132 transitions to the second temperature range 120, the RSM 100 begins to delegate control and turn off certain functions. In this embodiment, the digital signal processor components, such as codec 112, DSP 114, BLUETOOTH 116, and NFC 118 are no longer able to operate within their specified operational temperatures. Hence, RSM microprocessor 122 shuts off or disables these digital audio circuits—all digital audio is turned off, but retains the analog audio under RSM microprocessor control 122. In addition to the analog audio under microprocessor control remote speaker microphone 100 operating within the second temperature range continues to provide emergency, PTT, volume control, channel change and LED indicators. In this second temperature range, the audio includes only analog audio signal under the control of the RSM microprocessor 122 and emergency, PTT, volume control, and LED indicators. This second temperature range thus provides for an RSM that still provides mission critical audio in the form of analog audio under RSM microprocessor control.

As the monitored temperature 132 transitions to the third temperature range 130, the temperature sensitive microprocessor 122 of RSM 100 is turned off and functionality moves to a reduced feature set providing only mission critical functionality. Analog audio control is switched via audio switch 134 within the RSM 100. Hence the analog audio is switched over to a different electrical path during extreme operating temperature conditions. Again, all digital signal processing and related circuits remain shut down. The remote speaker microphone 100 operating within the third temperature range 130 continues to provide emergency and PTT through actuator and independent electrical paths without microprocessor control. The LED indicators will also remain function and triggered via the temperature sensor control 132. This third temperature range thus provides for an RSM 100 that still provides mission critical audio in the form of analog audio, the analog audio not being under RSM microprocessor control. The audio switch control 134 is completely controlled by the RSM and dependent upon the temperature control conditions. The RSM provides the audio signal over all temperature ranges. The radio processes the audio input signal dependent on the state of the separate (independent) PTT switch input state.

Figure 2:
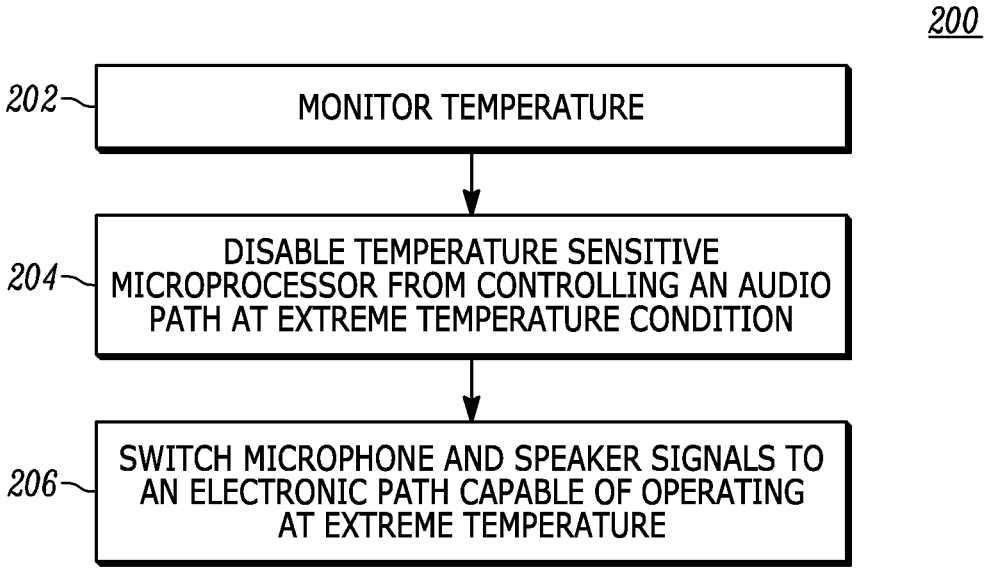
FIG. 2 is a method for expanded temperature operation of a communication device formed and operating in accordance with some embodiments.

FIG. 2 is a method 200 for expanded temperature operation of a communication device in accordance with some embodiments. The communication device may be for example, a portable battery operated communication device under microprocessor control, such as a remote speaker microphone wired to a portable radio which provides both analog audio and digital audio. Method 200 begins by monitoring a temperature of the communication device at 202. Temperature monitoring takes place throughout method 200. At 204, a temperature sensitive microprocessor is disabled upon reaching an extreme temperature condition, thereby disabling control of an audio path of the communication device. At 206 microphone and speaker signals of the communication device are switched to an electronic path (a non-microprocessor path) capable of operating at the extreme temperature condition. For example, a temperature sensitive microprocessor may be disabled, upon reaching a predetermined extreme temperature of 105 degrees Celsius, from controlling the audio path of the communication device. Microphone and speaker signals of the communication device will be switched to an electronic path capable of operating above the 105 degree temperature, for example within a range of 105-125 degrees Celsius.

In accordance with a further embodiment, operation over three temperature ranges may be provided by including the interim range of +85 to +105 degrees Celsius, where the microprocessor is still operational but the digital processing is shut down. In this embodiment, the first, nominal temperature range of −40 to +85 degrees Celsius allows enabling of digital microphone(s), analog microphone, noise suppression, emergency, PTT, volume control, channel change, and LED indicators with full microprocessor control. Next over the second, interim, temperature range of +85 to +105 degrees Celsius enabling of analog microphone, analog speaker, emergency, PTT, volume control, channel change and LED indicators occurs with shut down of all digital audio and noise suppression. Then, finally over the third extreme temperature range of +105 to +125 degrees Celsius the enabling of analog microphone, analog speaker, emergency, PTT, and LED indicators occurs. This third, extreme temperature range has no microprocessor control and includes rerouting and dedicated high performance circuits where applicable. For example, an external speaker coupled to the RSM is triggered, while the internal RSM speaker is turned off. Alternatively, if ultra high audio is desired and the internal RSM speaker is specified to the appropriate extreme temperature range then the combination of both speakers can be enabled.

Figure 3:
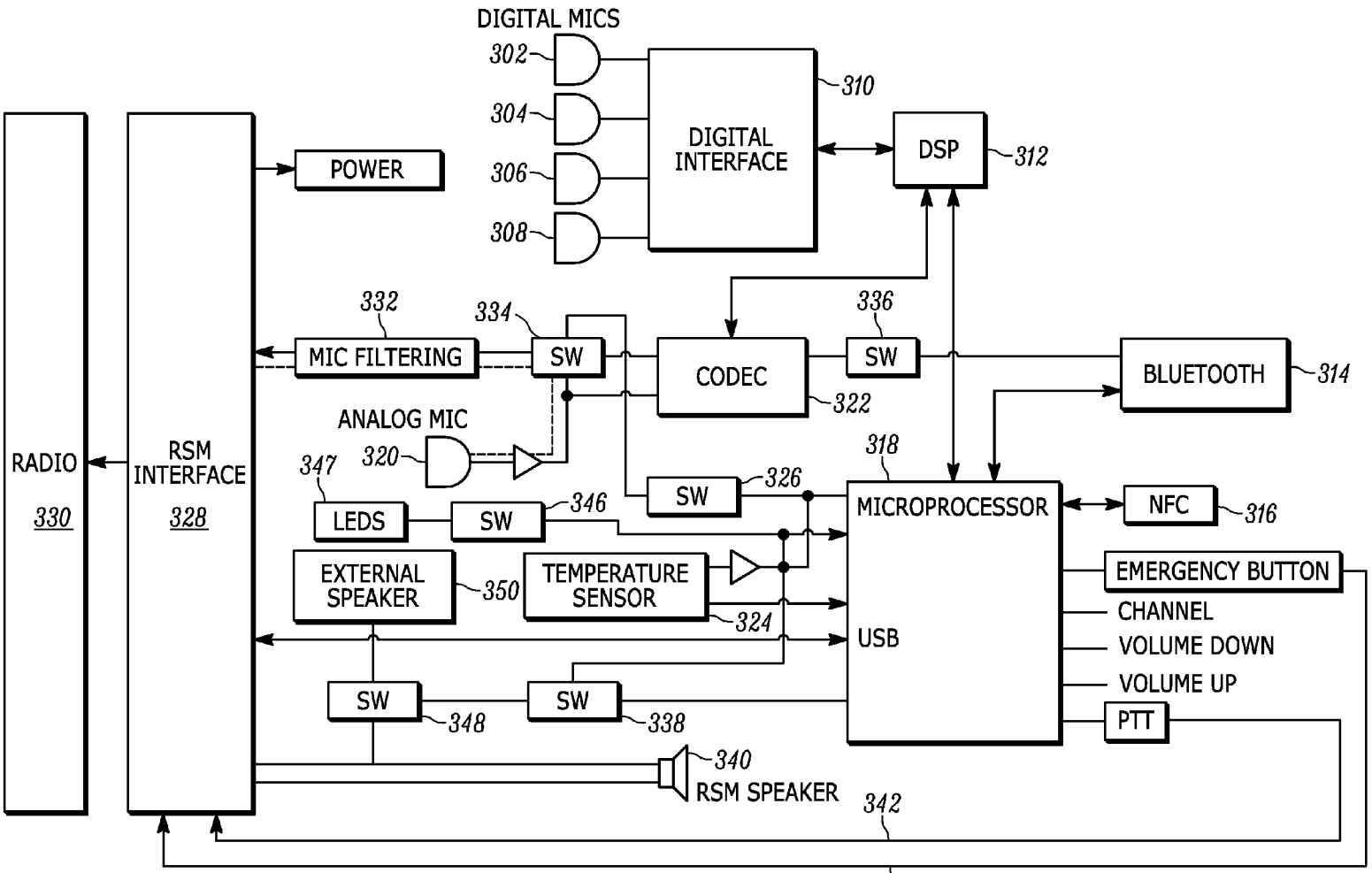
FIG. 3 is a simplified circuit block diagram of a portable communication system including a remote speaker microphone (RSM) formed and operating in accordance with some of the embodiments.

FIG. 3 is a simplified circuit block diagram of a portable communication system including a remote speaker microphone (RSM) 300, accessory/radio interface 328 and portable two-way radio 330 formed and operating in accordance with some of the embodiments. The communication system provides mission critical audio over an expanded temperature range. In accordance with some embodiments, the combination of shutting down functionality along with switching to different temperature tolerant paths and circuits allows for the mission critical operation to be maintained over the extended temperature range. The portable radio 330 may be for example, a narrowband APCO PROJECT 25 (P25) radio, a Terrestrial Trunked Radio (TETRA) radio, or other radio used in public safety bands for mission critical audio. The interface 228 may be embodied, as a P25 interface for a P25 radio, for example a global common accessory interface (GCAI) interface, or other appropriate P25 or TETRA interface capable of transferring mission critical audio over expanded temperature ranges.

The remote speaker microphone (RSM) 330 comprises a plurality of audio circuits under the control of a temperature sensitive microprocessor 318. The operation of the microprocessor 318 is specified over a temperature range −40° C. degrees Celsius to +105° C., however operation of the RSM 300 must remain functional for mission critical audio up to a temperature of +125° C. which presents the basis of the design challenge of the various embodiments.

Within the overall circuit, the audio circuits of RSM 300 comprise a plurality of digital microphones 302, 304, 304, 308, an analog microphone 320, microphone filtering 332, a speaker 340, a digital interface IC 310, a digital signal processor (DSP) 312 and an audio codec 322. Additional digital devices, such as Bluetooth 314 and Near Field Communication (NFC) 316 may also be available and controlled via the microprocessor 318. A plurality of switches 334, 336, 338, which generally represent the audio switch 134 of FIG. 1, operate for enabling, disabling and rerouting predetermined audio control functionality within the circuit.

The digital audio devices of the RSM 300 including the digital microphones 302, 304, 304, 308, the digital interface IC 310, the DSP 312, the codec 322, Bluetooth 314 and Near Field Communication (NFC) 316 are only operational up to +85° C. The microprocessor 318 and internal RSM speaker 340 are operational up to 105° C. The temperature sensor 324, the analog microphone 320, microphone filtering 332 and external analog speaker 350 are operational up to 125° C. All switches are operational up to from −40° C. to +125° C. In addition to digital audio control and analog audio control, the microprocessor 318 provides mission critical functionality control of push-to-talk (PTT), channel change, volume up, volume down and emergency button.

In a first mode of operation, first temperature range, (nominal/default) temperature conditions are determined by temperature sensor 324. The analog microphone output goes to both the codec and switch 334. Switch 326 acts as a breaker between the microprocessor and switch 334. From the speaker side, signals generated at RSM speaker 340 are switcheably enabled at switch 338 via microprocessor 318. In the first mode of operation, the RSM 300 receives audio at microphones 302, 304, 306, 308 and processes the received audio signals as product data management (PDM) data to a digital interface IC 310, where the digital interface 310 in turn converts the PDM data to a time division multiplexed (TDM) format. The TDM formatted data is then transferred to the digital signal processor (DSP) 312 for processing and combining with audio from the analog wind ported microphone 320 audio interfaced to the DSP 312 through the audio codec 322. The DSP 312 sums audio from all microphones 302, 304, 306, 308, 320 and processes the audio through an algorithm providing noise suppression.

Software algorithms running on the DSP 312 including use of multiple microphones to achieve wind noise suppression and beam forming to achieve background noise cancelling for overall advanced audio communication during the first mode of operation. A digital signal output from the DSP 312 is then fed back to the audio codec 322 where the digital audio is converted from digital to an analog signal. Further filtering 332 may be switcheably 334 applied to the analog signal prior to being transmitted over the accessory/radio interface 328 to the radio 330. The accessory/radio interface 328 may be for example a combined audio and data interface, such as for P25 radios and or TETRA, an example of which is a global common accessory interface (GCAI) for use with a P25 or TETRA radio 330. From the speaker side, signals generated at RSM speaker 340 are switcheably enabled at switch 338 via microprocessor 318. The analog microphone 320 is enabled, via switches 326, 334 in response to a temperature sensor 324 reaching a predetermined threshold. Accordingly, the first mode of operation allows fully operation PTT, Channel, volume up, volume down, PTT, digital audio and analog audio processing.

In a second mode of operation, the microprocessor 318 remains operational but shuts down digital audio functions which are unable to remain operate over a second predetermined temperature range, as determined by temperature sensor 324. In this second mode of operation, the digital microphones 302, 304, 306, 308 are not operational, and the DSP 312 and codec are shut down thereby turning off all noise suppression algorithms. The RSM 300 operates by receiving audio from the single analog wind ported microphone 320 which bypasses the codec 322 through switch 334 so as to transmit an analog signal directly to the accessory/radio interface 328 for use within the two-way radio 330 (dashed path). Switch 326, still controlled by microprocessor 318, now acts as a buffer between the microprocessor 318 and switch 334. Any Bluetooth 314 and NFC 316 operation capability are shut off. Signals generated at speaker 340 are switcheably controlled via microprocessor 318. In the second mode of operation, the microprocessor 318 still controls the PTT, analog audio, emergency, volume up, volume down and LED indicators. Communication between the radio 330 and RSM 300 occurs through the accessory/radio interface 328.

In the third mode of operation, digital audio remains shut down, an extreme temperature is sensed by sensor 324 failing within a predetermined extreme temperature range. The RSM 300 continues to receive audio from the single analog wind ported microphone 320 which is switched to bypass the codec 322 (shut down due to over temperature by sensor 324) and transmitted as an analog signal directly to the accessory/radio interface 328 for use within the two-way radio 330. However, in this third mode, the microprocessor 318 is further shut down and thus non-microprocessor controlled analog audio functions, PTT, and emergency are provided as mission critical features. The analog microphone operates as before switcheably bypassing the shutdown codec and being filtered through microphone filtering 332 prior to transfer to radio 330. The control of PTT is no longer processed through the microprocessor 318 but via a PTT hardware electrical path 342 to the radio 330. Similarly, the control of the emergency button is no longer processed through the microprocessor 318 but via an emergency hardware electrical path 341 to the radio 330. The LED temperature indicators 347 remain operational in temperature range 3, however no longer through the microprocessor 318 but rather through the temperature sensor triggering of switch 346. Speaker signals are rerouted as well to an external speaker 350. The purpose of switch 338 is to decouple microprocessor control 318 of another switch 348 between primary RSM speaker 340 and the secondary external accessory speaker 350, which has the effect of forcing the secondary external speaker 350 to become primary and be driven from the radio 330. Thus, separate audio circuitry and audio paths have been established and enabled during the third higher temperature range for mission critical audio. Although, speaker 350 is located externally the circuitry, for example switch 348, is still located on a single printed circuit board for all mission critical audio. A single printed circuit board rerouting high temperature paths and circuits has been provided.

Accordingly, there has been provided a portable communication device, system and method which provides for mission critical operation over an expanded temperature range. Initially, a portable accessory of the system senses a temperature within a nominal, first predetermined range thereby allowing for operation of a full audio feature set including digital and analog audio with noise suppression algorithms along with user interface parameters such as volume up, down, channel change, PTT, emergency, and LED temperature indicators. The full audio feature set is then defeatured (reduced, turned off) to a partial feature set over a second temperature range, where microprocessor control is retained but all digital audio is disabled, thereby shutting down all DSP, codec, noise suppression. The ability to use analog audio microphone and RSM speaker along with PTT, LED, Emergency button features still provides mission critical operation over this second temperature range. Once a predetermined extreme high temperature threshold is reached, the audio circuitry is changed to different high temperature audio circuitry optimized for operation at that higher temperature, for example changing speaker routing to an external speaker coupled the RSM as the primary speaker.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method of operating a communication device, comprising:

a microprocessor for:

monitoring a temperature of the communication device;

disabling the temperature sensitive microprocessor above a predetermined extreme temperature from control of an audio path of the communication device; and switching microphone and speaker signals of the communication device to an electronic path capable of operating above the predetermined extreme temperature.

2. The method of claim 1, further comprising:

prior to disabling:

maintaining digital audio and analog audio under temperature sensitive microprocessor control, in response to the monitored temperature being below a predetermined temperature; and turning off functionality to the digital audio while the analog audio remains under temperature sensitive microprocessor control, in response to the monitored temperature reaching a predetermined temperature range.

3. The method of claim 1, wherein turning off functionality to the digital audio comprises turning off noise suppression.

4. The method of claim 1, further comprising switching in, by the microprocessor, high temperature audio circuitry for processing microphone and speaker signals in the electronic path to provide mission critical audio functionality.

5. The method of claim 1, wherein the communication device comprises a remote speaker microphone (RSM).

6. The method of claim 5, wherein the RSM circuitry is on a single printed circuit board.

7. The method of claim 6, further comprising enabling a secondary external speaker as a high performance circuit above the predetermined extreme temperature.

8. The method of claim 2, wherein enabled operation over three temperature ranges comprises:

enabling digital microphone, analog microphone, noise suppression, emergency, PTT, volume control, channel change, and LED indicators over a first, nominal temperature range;

enabling analog microphone, analog speaker, emergency, PTT, volume control, channel change and LED indicators over a second temperature range; and enabling analog microphone, analog speaker, emergency, PTT, and LED indicators over a third temperature range.

9. A method of operating a portable communication system, comprising:

a microprocessor performing:

sensing a temperature of the communication device;

operating a full audio feature set over a first temperature range;

defeaturing the full audio feature set to a partial audio feature set over a second temperature range; and changing to different high temperature optimized audio circuitry in response to a predetermined high temperature threshold being reached.

10. The method of claim 9, wherein operating the full audio feature set further comprises enabling the microprocessor and a digital signal processor to control full digital and analog audio of the communication device, and wherein defeaturing the full audio feature set further comprises disabling the digital signal processor to disable all digital audio while retaining analog audio under microprocessor control, and wherein changing to a different high temperature optimized audio circuitry further comprises disabling the microprocessor and enabling an electronic analog audio path for the analog audio.

11. The method of claim 9, wherein defeaturing comprises reducing functionality.

12. The method of claim 9, wherein reducing functionality comprises: turning off all circuits related to noise suppression.

13. The method of claim 9, wherein the high temperature audio circuitry provides mission critical audio functionality.

14. The method of claim 9, wherein the communication device comprises a remote speaker microphone.

15. The method of claim 9, changing to different high temperature optimized audio circuitry in response to the predetermined high temperature threshold being reached comprises:

switching in an external speaker coupled to the RSM as a primary speaker; and shutting down an internal RSM speaker.

16. A communication system, comprising:

a portable radio;

a remote speaker microphone (RSM) having an RSM microprocessor;

an interface coupling the RSM to the portable radio, the RSM providing, under RSM microprocessor control, digital audio processing and analog audio processing over a first temperature range to generate an analog audio signal to the radio through the interface;

the RSM providing all-analog audio communication under RSM microprocessor control over a second temperature range to generate an analog audio signal to the radio through the interface and the RSM providing all-analog mission critical audio operation, without noise suppression, using high performance audio circuitry and a dedicated electrical path, without control of the RSM microprocessor over a third temperature range to generate an analog audio signal to the radio through the interface.

17. The communication system of claim 16, wherein the all-analog mission critical audio operation comprises:

analog microphone, analog speaker, emergency, push-to-talk (PTT), and light emitting diode (LED) indicators.

18. The communication system of claim 16, wherein the third temperature range is an expanded range beyond a temperature range specified for operation by the microprocessor and digital audio components, thereby providing for mission critical audio operation of the RSM over an expanded temperature range.

19. The communication system of claim 16, further comprising: an external speaker coupled to the RSM, the external speaker being enabled during the third temperature range.

* * * * *